United States Patent [19]

Kuo et al.

[11] Patent Number: 4,991,785

[45] Date of Patent: Feb. 12, 1991

[54] REEL CLAMPING DEVICE

[75] Inventors: John Kuo; Ming-Shung Cho, both of Hsin-Chu, Taiwan

[73] Assignee: Mirle Automation Corporation, Hsin-Chu, Taiwan

[21] Appl. No.: 470,762

[22] Filed: Jan. 26, 1990

[51] Int. Cl.[5] ..... B65H 75/18

[52] U.S. Cl. ..... 242/68.3

[58] Field of Search ..... 242/68.3, 68.4, 129.5, 242/68.1, 68.2, 72 R, 72.1

[56] References Cited

U.S. PATENT DOCUMENTS

| | | | |
|---|---|---|---|
| 3,294,337 | 12/1966 | Jacob | 242/68.3 |
| 3,565,360 | 2/1971 | Ura | 242/68.3 |
| 3,596,846 | 8/1971 | Johnston | 242/68.3 |
| 4,311,287 | 1/1982 | Evers | 242/68.3 |

*Primary Examiner*—John M. Jillions

*Attorney, Agent, or Firm*—Michael L. Keller

[57] ABSTRACT

A reel clamping device which is capable of positioning a reel rapidly and precisely. The reel clamping device is composed of a cylindrical shell having a plurality of through slots extended parallelly with the axis thereof; a screw bolt rotatably disposed within the shell, whose first and second threaded end portions have different thread directions; a jaw base mated to the first threaded end portion of the screw bolt; a plurality of first jaws fixed onto the jaw base and protruding from the through slots formed in the shell; a plurality of second jaws; a jaw seat mated to the second threaded end portion of the screw bolt, for accommodating the second jaws in such a way that the second jaws can protrude from or retract into the through slots freely; a second jaw drive mechanism mated to the second threaded end portion of the screw bolt, for driving the second jaws to protrude from or to retract into the through slots; and a handle for driving the screw bolt to rotate around its longitudinal axis so as to conduct the base and the seat to move toward or apart from each other and simultaneously to conduct the second jaws to protrude from or to retract into the through slots. The second jaw drive mechanism can conduct the second jaws to protrude from or to retract into the through slots within one turn of rotation about the axis of the shell, and the second jaw drive means is mated to the second threaded end portion of the screw bolt in such a way that it can be conducted to rotate integrally with the screw bolt by an adjustable frictional torque existed therebetween.

4 Claims, 8 Drawing Sheets

REEL CLAMPING DEVICE

BACKGROUND OF THE INVENTION

The present invention relates generally to a reel clamping device, particularly to a reel clamping device which is capable of positioning a reel rapidly and precisely.

A reel is often used in a sheet supply mechanism of a packaging machine in which, a continuous strip of wrapping sheet is wound on the reel to supply the packaging machine with wrapping sheets. However, an exchange of two reels of different size is often needed during the process of manufacture, and the middle of the new reel has to be disposed exactly where that of the old one was. For this reason, the clamping and the positioning of a new reel is time-consuming, and expertise of the operator is required.

A reel clamper is disclosed in the Japanese Pat. Publication Gazette with No. Sho 62-167919. FIG. 1 is a cross-sectional view showing the construction of the reel clamper; and FIG. 2 is an exploded perspective view showing the construction of the reel clamper. As shown in FIGS. 1 and 2, the reel clamper comprises a cylindrical shell 102 which is provided with a plurality of through slots 101; a screw bolt 103 with two different threaded end portions 103*a*, 103*b*; a stopper 104 mated to the threaded end portion 103*a*; and a base 105 mated to the threaded end portion 103*b*. A slider 106 is disposed around the small end portion of the stopper 104, and three jaws 107 are pivotally connected to the slider 106. Three jaws 108 are fixed onto the base 105. Because the threaded portions 103*a* and 103*b* have different thread directions, the stopper 104 and the base 105 will be driven to move toward or apart from each other when the screw bolt 103 is driven to rotate by means of a handle 109. When the handle 109 is rotated, the rubber ring 106*b* disposed around the slider 106 will hinder the slide of the slider 106 during which the jaws 107 retract or protrude, and the jaws 107 and 108 accommodated within the slots 101 will be driven to move together with the stopper 104 and the base 105 along the axis of the screw bolt 103. Under this circumstance, the jaws 107 will be conducted by the inclined surface 104*a* of the stopper 104 to move radially outward and urge one end portion of the reel 110 (see FIG. 1) so that the jaws 107 will incorporate with the jaws 108 to clamp the reel 110 firmly. Reels clamped by such a clamper will be precisely positioned if the position of the base 105 relative to the screw bolt 103 is well adjusted before operation of the clamper. However, the jaws 107 must retract into the slots 101 of the shell 102 before the reel 110 can be removed from the shell 102, and the operator must rotate the handle 109 several turns to replace an old reel with a new one.

SUMMARY OF THE INVENTION

The primary object of the present invention is to provide a reel clamping device which is capable of positioning a reel rapidly and precisely.

In accordance with the present invention, a reel clamping device comprises a cylindrical shell having a plurality of through slots extending parallelly with the axis thereof; a screw bolt rotatably disposed within the shell, whose first and second threaded end portions have different thread directions; a jaw base mated to the first threaded end portion of the screw bolt; a plurality of first jaws fixed onto the jaw base and protruding from the through slots formed in the shell; a plurality of second jaws; a jaw seat mated to the second threaded end portion of the screw bolt, for accommodating the second jaws in such a way that the second jaws can protrude from or retract into the through slots freely; means mated to the second threaded end portion of the screw bolt, for driving the second jaws to protrude from or to retract into the through slots; and means for driving the screw bolt to rotate around its longitudinal axis so as to conduct the base and the seat to move toward or apart from each other and simultaneously to conduct the second jaws to protrude from or to retract into the through slots. The reel is characterized in that the second jaw drive means can conduct the second jaws to protrude from or to retract into the through slots within one turn of rotation about the axis of the shell, and the second jaw drive means is mated to the second threaded end portion of the screw bolt in such a way that it can be conducted to rotate integrally with the screw bolt by an adjustable frictional torque existed therebetween.

BRIEF DESCRIPTION OF THE DRAWINGS

The present invention can be more fully understood by reference to the following description and accompanying drawings, which form an integral part of this application.

DETAILED DESCRIPTION OF THE PREFERRED EMBODIMENTS

Figure 1:
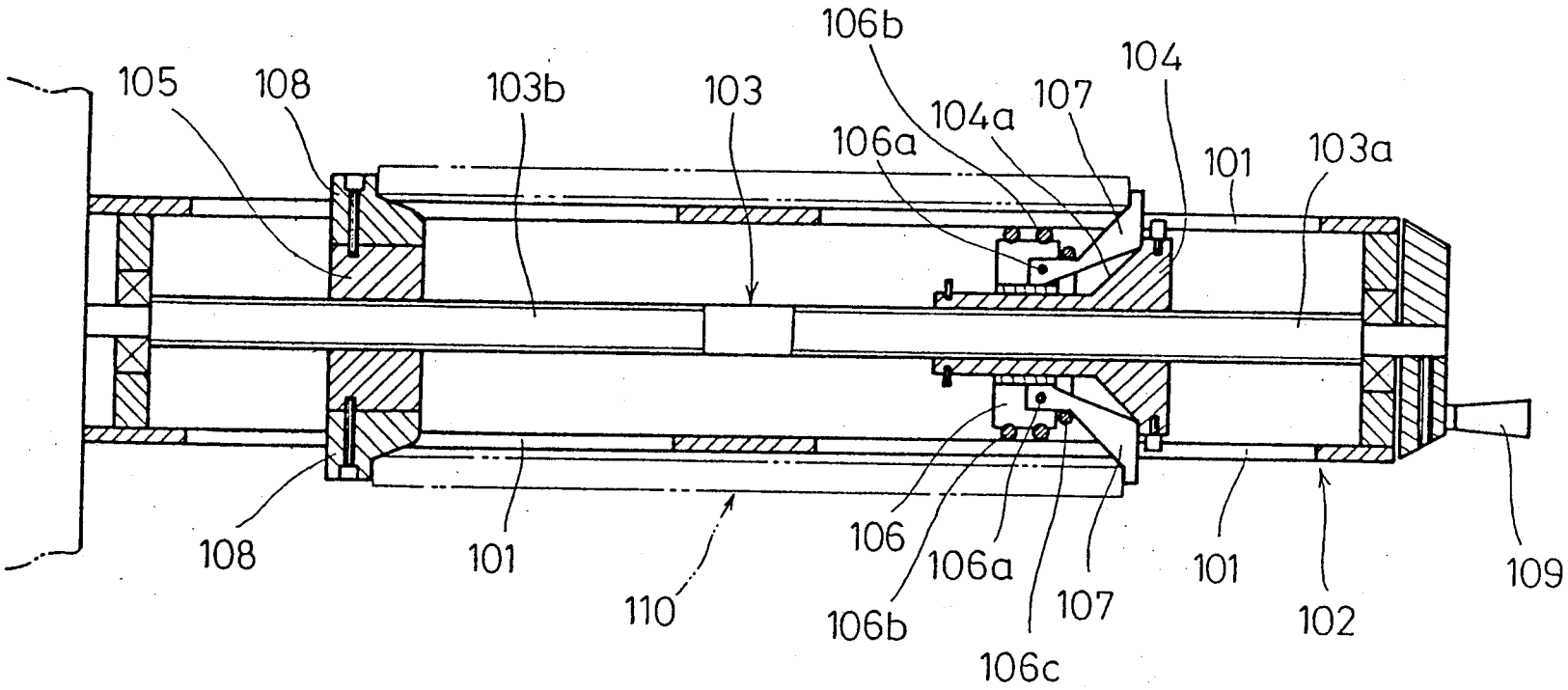
(PRIOR ART) FIG. 1
FIG. 1 is a cross-sectional view showing the construction of a reel clamper disclosed in the Japanese Patent Publication Gazette with No. Sho 62-167919.
Figure 2:
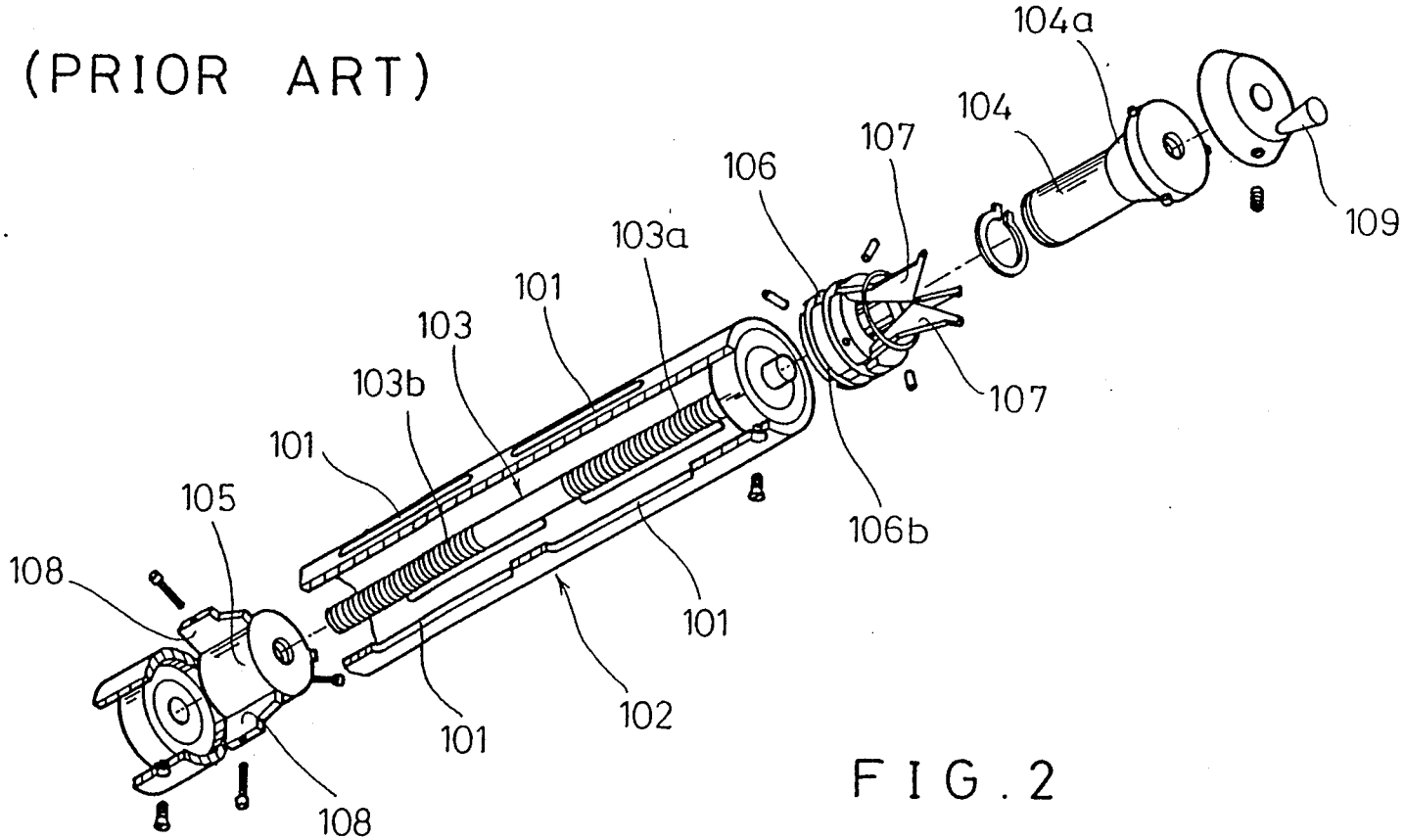
(PRIOR ART) FIG. 2
FIG. 2 is an exploded perspective view showing the construction of the reel clamper shown in FIG. 1.
Figure 3:
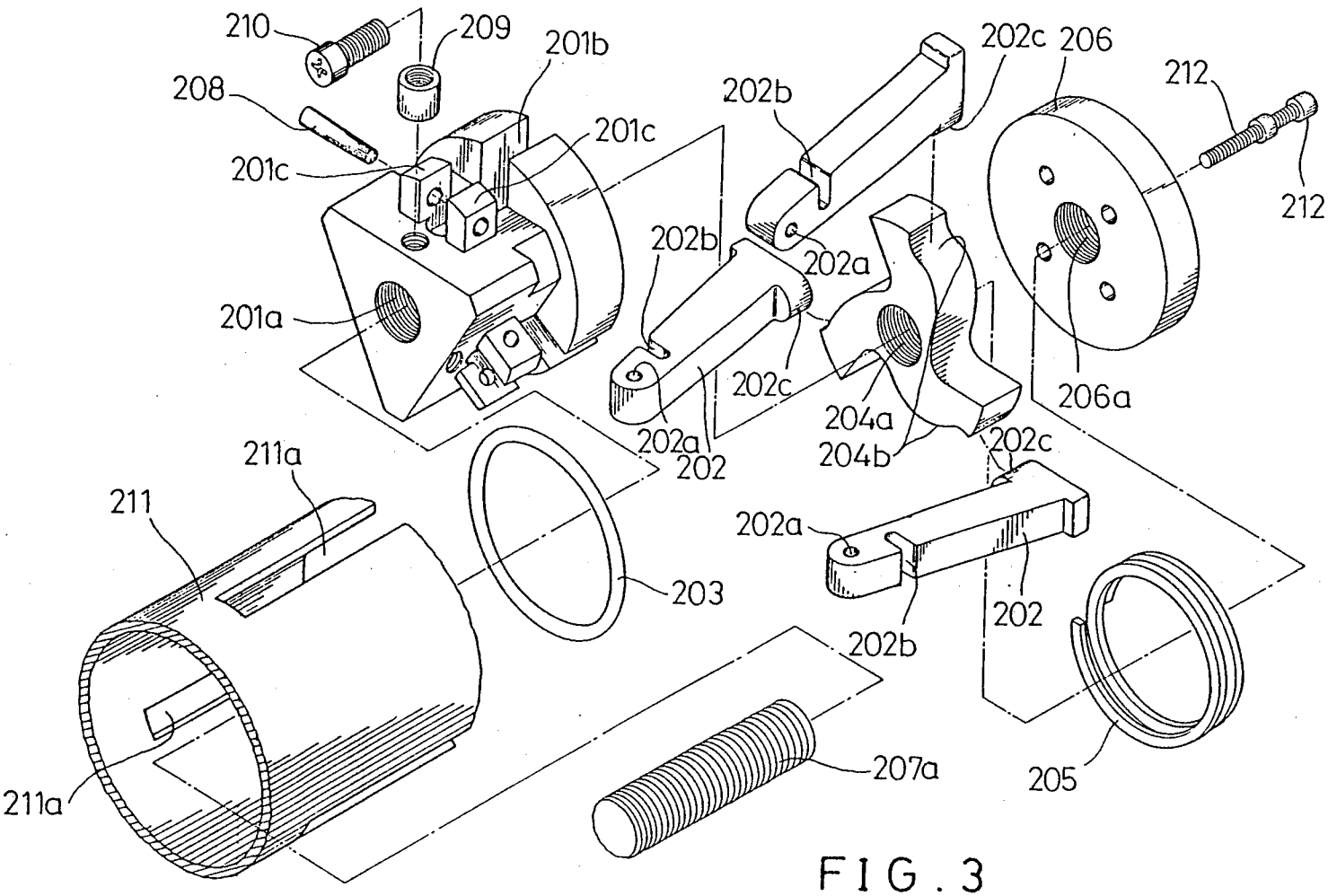
FIG. 3 is an exploded perspective view showing the construction of the jaw drive mechanism of the reel clamping device according to the first embodiment of this invention.
Figure 4:
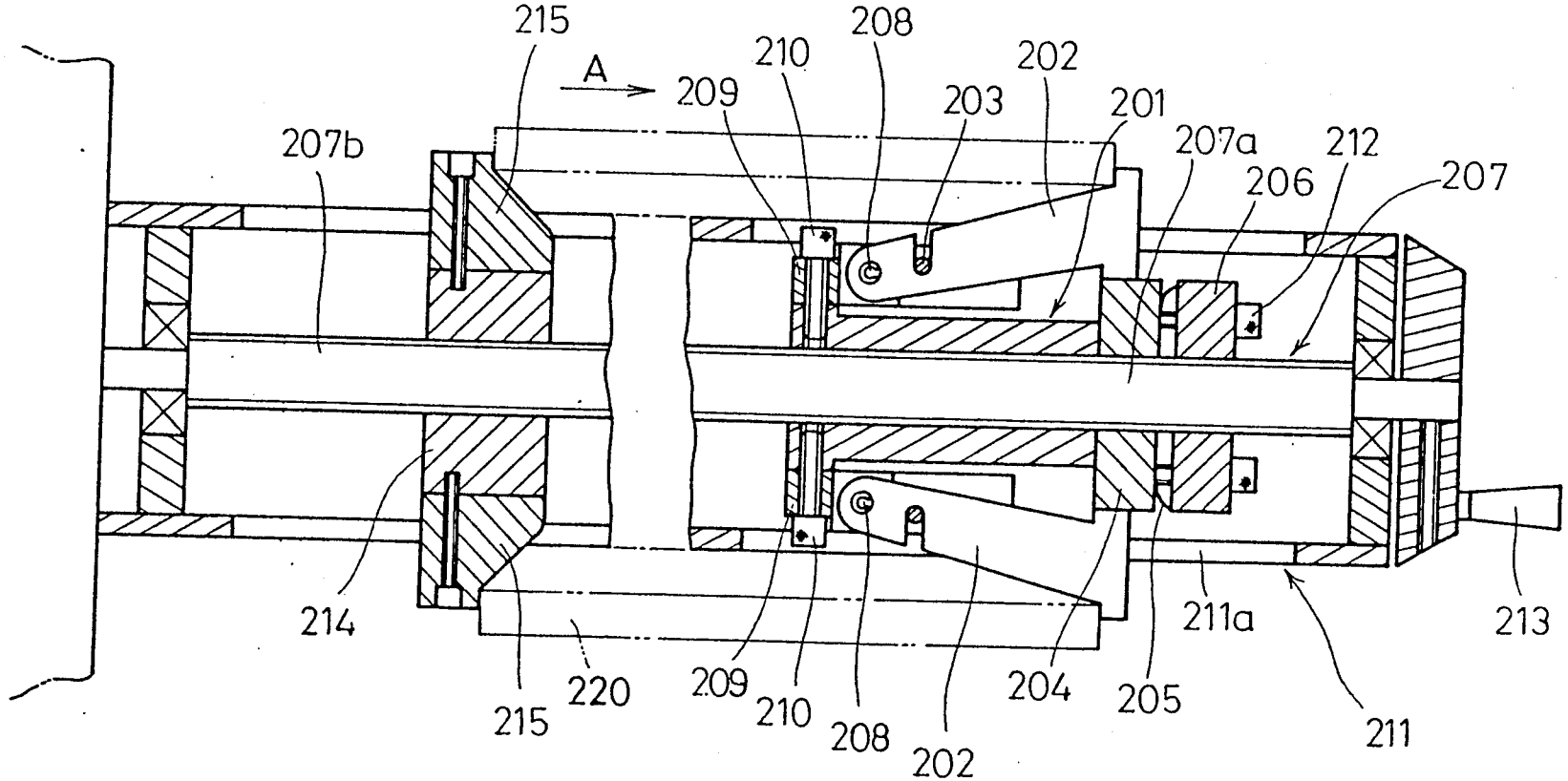
FIG. 4 is a cross-sectional view showing the construction of the reel clamping device according to the first embodiment of this invention.

As shown in FIG. 3, the jaw drive mechanism of the reel clamping device according to the first embodiment of this invention comprises a jaw seat 201, three jaws 202; an elastic ring 203; a cam 204; a spring washer 205; and a frictional force adjusting nut 206. As shown in FIG. 4, the jaw drive mechanism is accommodated within a cylindrical shell 211 and mated to the threaded end portion 207*a* of the screw bolt 207 extending along the axis of the cylindrical shell 211. The other threaded end portion 207*b* of the screw bolt 207 is mated to a base 214, and three jaws 215 are fastened to the base 214 and the jaws 215 are similar to those of the base 105 and the jaws 108 shown in FIG. 1, and the description of their constructions is therefore omitted. However, it should be noted that the two threaded end portions 207*a* and 207*b* of the screw bolt 207 have different thread directions. Furthermore, three through slots 211*a* extending parallelly with the axis of the screw bolt 207 are formed on the cylindrical shell 211.

The following is a description of the construction of the jaw drive mechanism shown in FIG. 3. A threaded bore 201*a* mated to the threaded portion 207*a* of the screw bolt 207 is provided at the central portion of the jaw seat 201, and three radial sots 201*b* are formed in the jaw seat 201 (see FIG. 3). The jaws 202 are pivotally connected to the tabs 201*c* of the jaw seat 201 by pivot pins 208, and the jaws 202 are restrained by the elastic ring 203 disposed at the recesses 202*b* of the jaws 202 (see FIG. 4). With this arrangement, the jaws 202 will be urged by the elastic ring 203 to retract into the slots 211*a* of the shell 211 and will be conducted to protrude outward from the through slots 211*a* when the protrusions 202*c* of the jaws 202 are urged by the cam surfaces 204*b* of the cam 204 (will be described hereinafter). The collars 209 are secured to the jaw seat 201 by the screws 210, and the top portions thereof are restrained within the slots 211*a* (see FIG. 4) so as to prevent the rotation of the jaw seat 201 when the jaw seat 201 is driven to move along the axis of the screw bolt 207.

When assembled, the threaded bore 204*a* of the cam 204 is mated to the threaded portion 207*a* of the screw bolt 207, and the protrusions 202*c* of the jaws 202 are urged to contact the cam surfaces 204*b* of the cam 204 by the elastic ring 204, and the spring washer 205 is restrained between the cam 204 and the frictional force adjusting nut 206. The cam 204 and the frictional force adjusting nut 206 are connected by the screws 212, and the restrained spring washer 205 will urge them to move apart from each other, and thus the frictional forces existing between the threads of the threaded end portion 207*b* and the threads of the threaded bores 204*a*, 206*a* can be adjusted by adjusting the gap between the cam 204 and the frictional force adjusting nut 206. With this arrangement, the shorter the gap is, the larger the frictional forces are, and if the magnitude of the frictional forces is adjusted to fall within a certain proper range, then the cam 204 and the frictional force adjusting nut 206 will be driven to rotate integrally with the screw bolt 207 to conduct the jaws 202 to protrude from or retract into the through slots 211*a*. It should be noted that the jaws 202 will be conducted to complete the protrusion or the retraction movement within one turn of rotation of the screw bolt 207.

The following is a description of the operation of the first embodiment of the reel clamping device according to this invention. As shown in FIG. 4, a reel 220 is clamped by the reel clamping device. Under this circumstance, the protrusions 202*c* of jaws 202 are urged to their outermost positions by the cam surfaces 204*c*. It should be noted that the cam 204 will be conducted to rotate integrally with the screw bolt 207 to lower the jaws 202 at the beginning of the rotation of the screw bolt 207. Thus, if the screw bolt 207 is driven to rotate, then the jaws 202 will be lowered and will immediately retract into the slots 211*a*, and the reel 220 can be removed from the shell 211 along the direction of arrow A. After removing the old reel 220, a new one can be sleeved on the shell 211 and can be clamped readily by rotating the handle 213. Because the threaded portions 207*a* and 207*b* are different in thread directions, the jaw seat 201 and the base 214 will be driven to move toward or apart from each other when the screw bolt 207 is driven to rotate by means of the handle 213. Thus, if the length of the new reel is different from that of the old one, then the distance between the jaw seat 201 and the base 214 should be adjusted by rotating the handle 213. However, if the distance has been adjusted, the exchange of reels will be performed rapidly and precisely.

Figure 5:
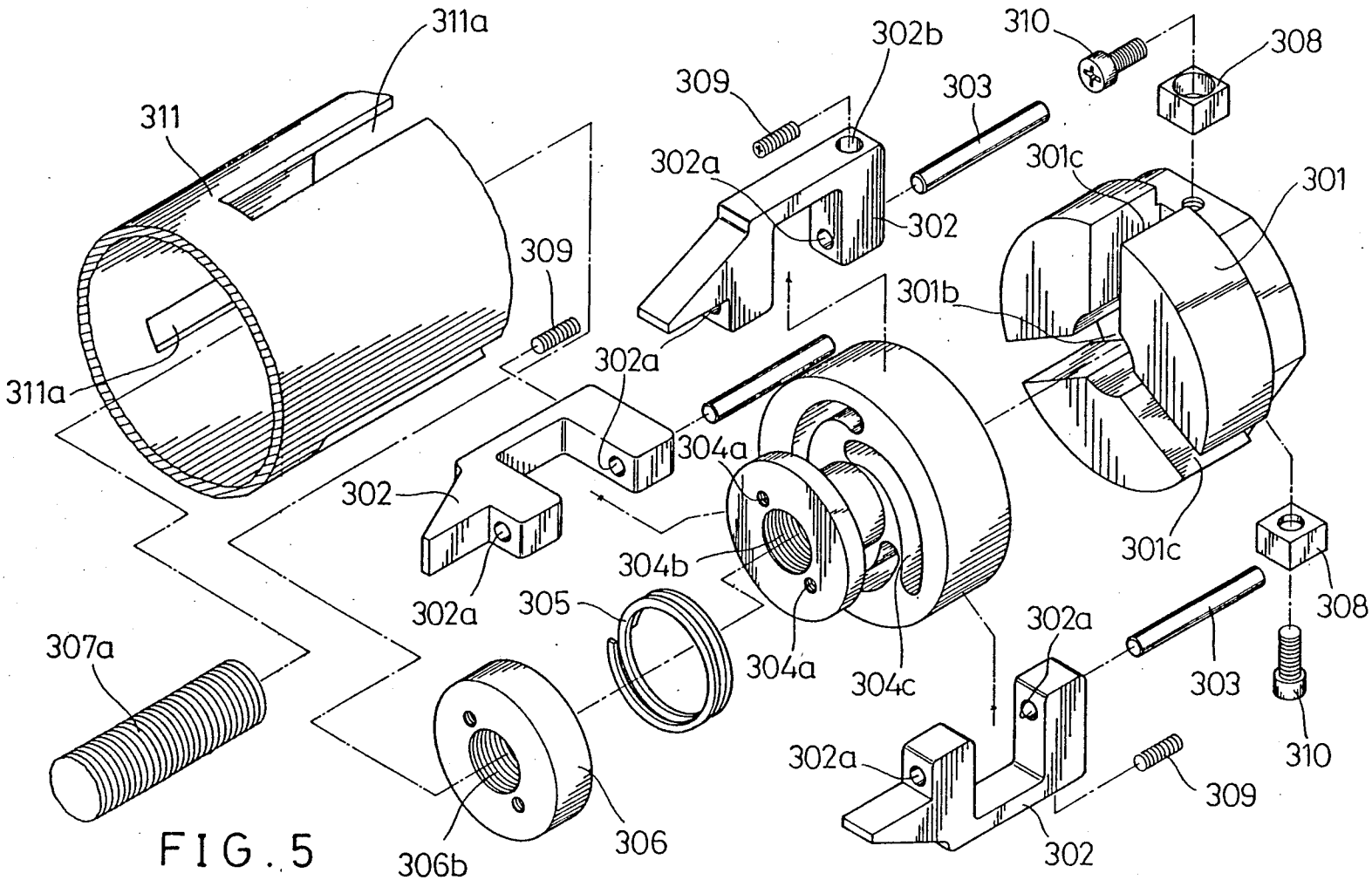
FIG. 5 is an exploded perspective view showing the construction of the jaw drive mechanism of the reel clamping device according to the second embodiment of this invention.
Figure 6:
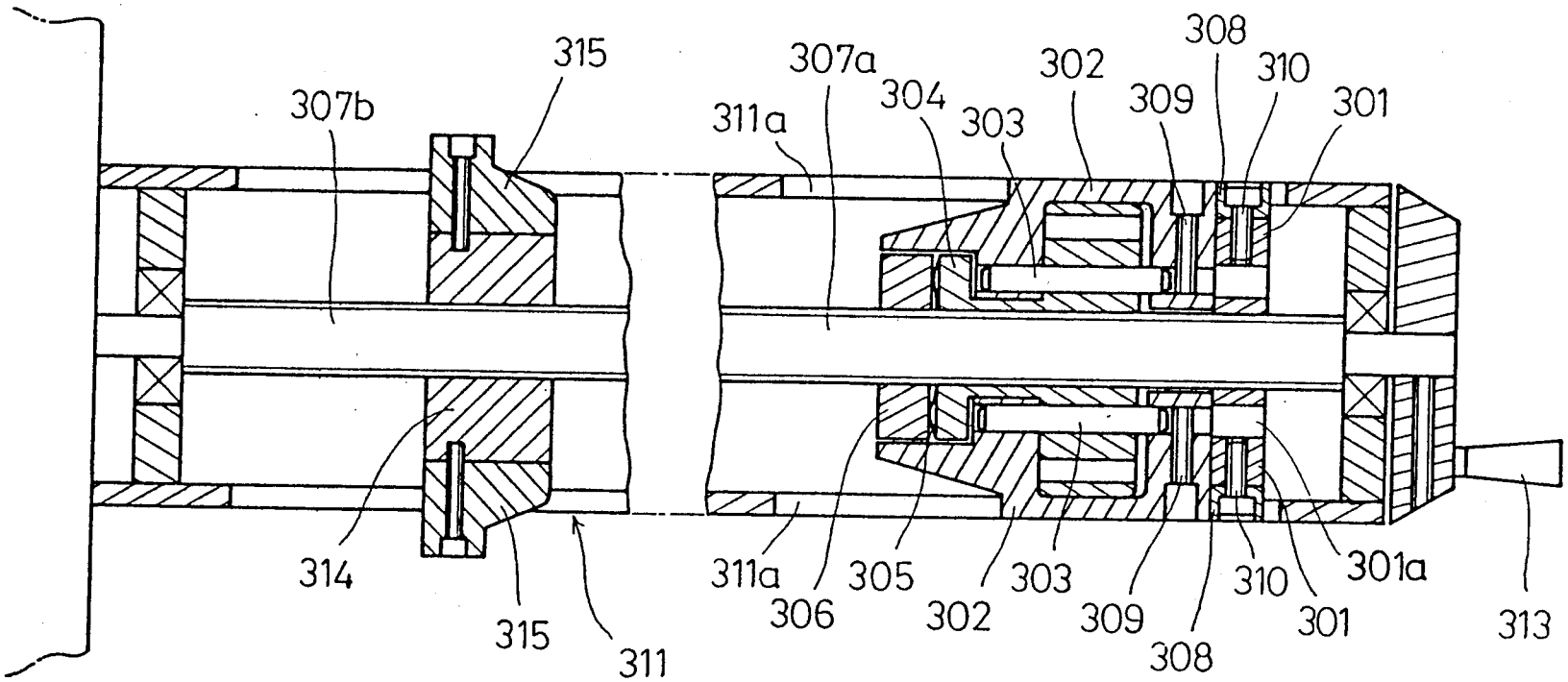
FIG. 6 is a cross-sectional view showing the construction of the reel clamping device according to the second embodiment of this invention.

The following is a description of the construction of the jaw drive mechanism of the reel clamping device according to the second embodiment of this invention. As shown in FIG. 5, the jaw drive mechanism of the reel clamping device according to the second embodiment of this invention comprises a guide member 301, three jaws 302; three pins 303; a cam 304; a spring washer 305; and a frictional force adjusting nut 306. As shown in FIG. 6, the jaw drive mechanism is accommodated within a cylindrical shell 311 and mated to the threaded end portion 307*a* of the screw bolt 307 extending along the axis of the cylindrical shell 311. The other threaded end portion 307*b* of the screw bolt 307 is mated to a base 314, and three jaws 315 are fastened to the base 314 by three screws. The constructions of the screw bolt 307, the shell 311, the base 314, and the jaws 315 are similar to those of the screw bolt 207, the shell 211, the base 214, and the jaws 215 shown in FIG. 4, and the description of their constructions is therefore omitted. As shown in FIG. 5, three threaded bores 301*b*, 304*b*, 306*b* are respectively provided at the central portions of the guide member 301, the cam 304, the frictional force adjusting nut 306, for mating to the threaded portion 307*a* of the screw bolt 307. When assembled, the spring washer 305 is restrained between the cam 304 and the frictional force adjusting nut 306. The cam 304 and the frictional force adjusting nut 306 are connected by the screws (not shown), and the restrained spring washer 305 will urge them to move apart from each other, and thus the frictional forces existing between the threads of the threaded end portion 307*a* and the threads of the threaded bores 304*b*, 306*b* can be adjusted by adjusting the gap between the cam 304 and the frictional force adjusting nut 306. With this arrangement, the shorter the gap is, the larger the frictional forces are, and if the magnitude of the frictional forces is adjusted to fall within a certain proper range, then the cam 304 and the frictional force adjusting nut 306 will be driven to rotate integrally with the screw bolt 307. Furthermore, as shown in FIG. 6, the outer peripheral wall of the cam slots 304*c* of the cam 304 is disposed between opposite legs of the jaws 302, and the pins 303 penetrate through the cam slots 304*c* with their opposite end portions remaining in the through bores 302*a* formed in each of the legs of the jaws 302. With this arrangement, the jaws 302 will be conducted by the cam 304 to rise from or sink into the through slots 311*a* of the shell 311 when the cam 304 is integrally rotated with the screw bolt 307. The blocks 308 are secured to the guide member 301 by the screws 310, and the top portions thereof are restrained within the slots 311*a* (see FIG. 6) so as to prevent the rotation of the guide member 301 when the guide member 301 is driven to move along the axis of the screw bolt 307. The screws 309 mated to the threaded bores 302*b* can prevent the pins 303 from slipping away from their operation position.

The operation of the second embodiment of the reel clamping device is similar to that of the first embodiment of the reel clamping device, and its description is therefore omitted. However, it should be noted that the jaws 302 will be conducted to complete the rising or sinking movement within one turn of rotation of the screw bolt 307.

Figure 7:
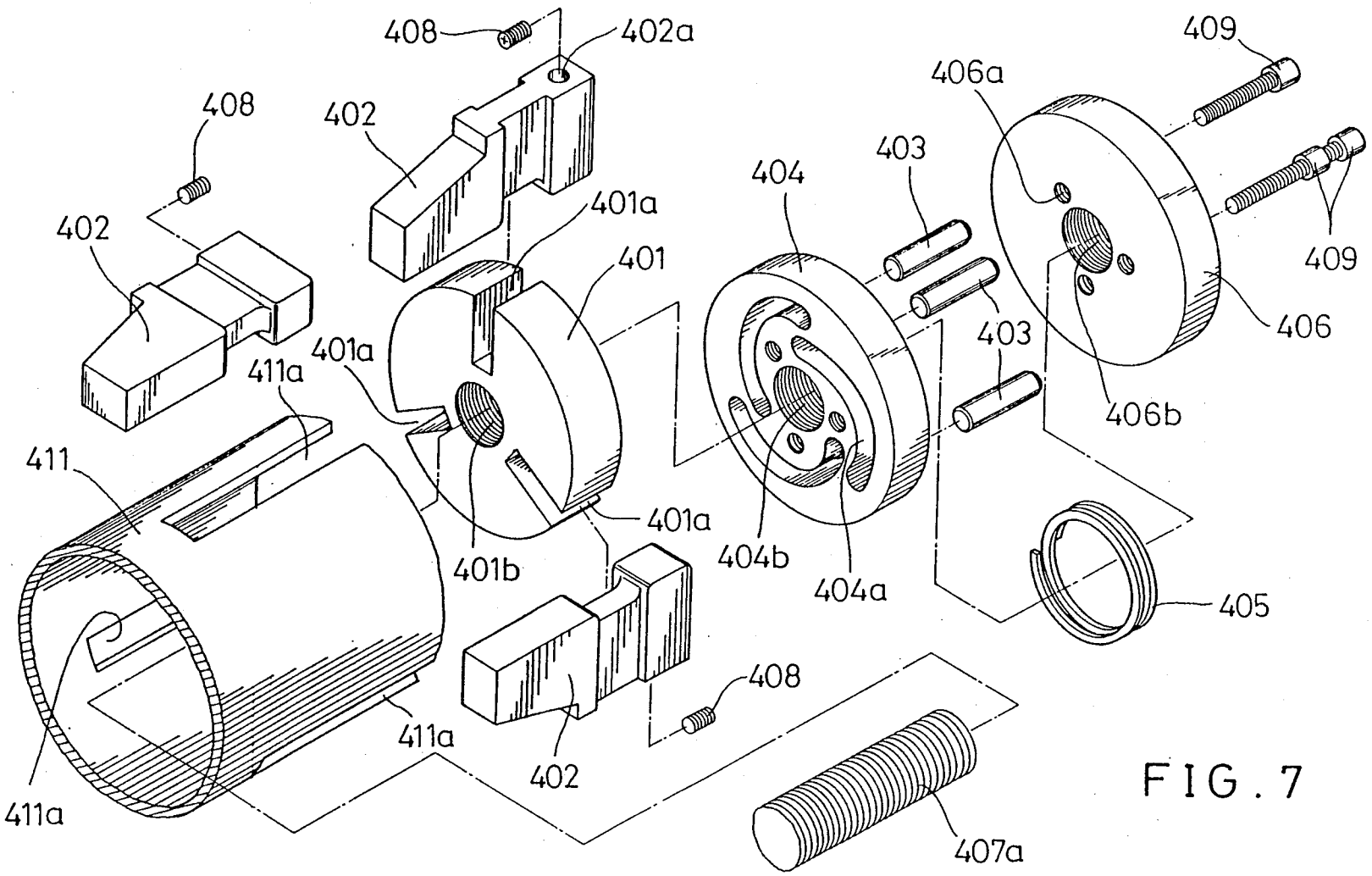
FIG. 7 is an exploded perspective view showing the construction of the jaw drive mechanism of the reel clamping device according to the third embodiment of this invention.
Figure 8:
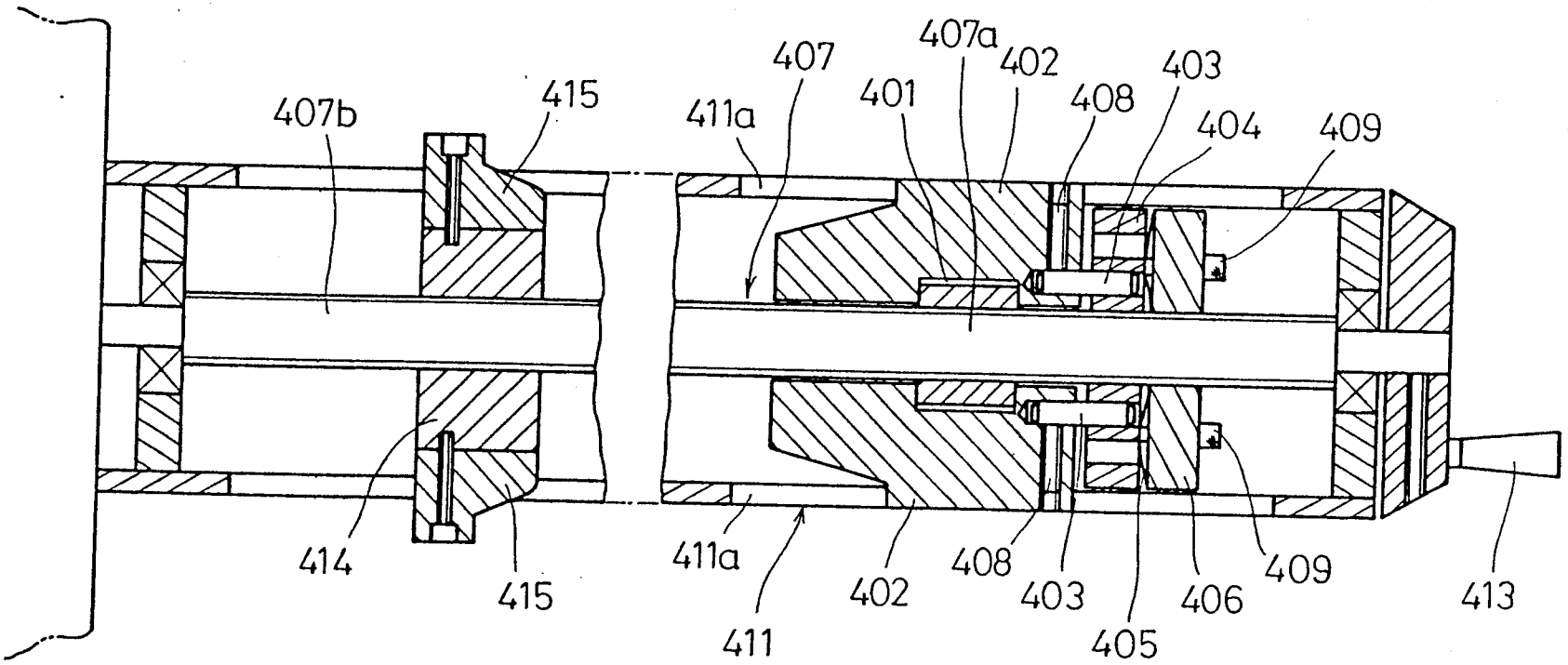
FIG. 8 is a cross-sectional view showing the construction of the reel clamping device according to the third embodiment of the invention.

The following is a description of the construction of the jaw drive mechanism of the reel clamping device according to the third embodiment of this invention. As shown in FIG. 7, the jaw drive mechanism of the reel clamping device according to the third embodiment of this invention comprises an accommodation member 401, three jaws 402; three pins 403; a cam 404; a spring washer 405; and a frictional force adjusting nut 406. The accommodation member 401 is provided with three radial slots 401*a* for accommodating the jaws 402. As shown in FIG. 8, the jaw drive mechanism is accommodated within a cylindrical shell 411 and mated to the threaded end portion 407*a* of the screw bolt 407 extending along the axis of the cylindrical shell 411. The other threaded end portion 407*b* of the screw bolt 407 is mated to a base 414, and three jaws 315 are fastened to the base 414 by three screws. The constructions of the screw bolt 407, the shell 411, the base 414, and the jaws 415 are similar to those of the screw bolt 207, the shell 211, the base 214, and the jaws 215 shown in FIG. 4, and the description of their constructions is therefore omitted. As shown in FIG. 7, three threaded bores 401*b*, 404*b*, 406*b* are respectively provided at the central portions of the accommodation member 401, the cam 404, the frictional force adjusting nut 406, for mating to the threaded portion 407*a* of the screw bolt 407. When assembled, the spring washer 405 is restrained between the cam 404 and the frictional force adjusting nut 406. The cam 404 and the frictional force adjusting nut 406 are connected by the screws 409, and the restrained spring washer 405 will urge them to move apart from each other, and thus the frictional forces existing between the threads of the threaded end portion 407*a* and the threads of the threaded bores 404*b*, 406*b* can be adjusted by adjusting the gap between the cam 404 and the frictional force adjusting nut 406. With this arrangement, the shorter the gap is, the larger the frictional forces are, and if the magnitude of the frictional forces is adjusted to fall within a certain proper range, then the cam 404 and the frictional force adjusting nut 406 will be driven to rotate integrally with the screw bolt 407. As shown in FIG. 8, the pins 403 penetrate through the cam slots 404*a* with their end portions remaining in the bores formed in the legs of the jaws 402. With this arrangement, the jaws 402 will be conducted by the cam 404 to rise from or sink into the through slots 411*a* of the shell 411 when the cam 404 is integrally rotated with the screw bolt 407. The top portions of the jaws 402 are restrained within the slots 411*a* (see FIG. 8) so as to prevent the rotation of the accommodation member 401 when the accommodation member 401 is driven to move along the axis of the screw bolt 407. The screws 408 mated to the threaded bores 402*a* can prevent the pins 403 from slipping away from their operation position.

The operation of the third embodiment of the reel clamping device is similar to that of the second embodiment of the reel clamping device, and its description is therefore omitted. However, it should be noted that the jaws 402 will be conducted to complete the rising or sinking movement within one turn of rotation of the screw bolt 407.

As described above, the reel clamping device according to this invention is capable of positioning a reel rapidly and precisely.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A reel clamping device comprising:

a cylindrical shell having a plurality of through slots extending parallelly with the axis thereof;

a screw bolt rotatably disposed within said shell, whose first and second threaded end portions have different thread directions;

a jaw base mated to the first threaded end portion of said screw bolt;

a plurality of first jaws fixed on said jaw base and protruding from said through slots formed in said shell;

a plurality of second jaws;

a jaw seat mated to the second threaded end portion of said screw bolt, for accommodating said second jaws in such a way that said second jaws can protrude from or retract into said through slots freely;

means mated to the second threaded end portion of said screw bolt, for driving said second jaws to protrude from or to retract into said through slots; and means for driving said screw bolt to rotate around its longitudinal axis so as to conduct said base and said seat to move synchronously toward or apart from each other and to conduct said second jaws to protrude from or to retract into said through slots simultaneously, characterized in that said second jaw drive means can conduct said second jaws to protrude from or to retract into said through slots within one turn of rotation about the axis of said shell, and means for adjusting the frictional torque between the second jaw drive means and the second threaded end portion of said screw bolt in such a way that the second jaw drive means can be frictionally torqued to rotate integrally with the screw bolt.

2. A reel clamping device as claimed in claim 1, wherein said second jaw drive means comprises:

a cam mated to the second threaded end portion of said screw bolt, for driving said second jaws to protrude from or to retract into said through slots when said cam is rotated integrally with said screw bolt;

and wherein said adjusting means comprise a frictional force adjusting nut mated to the second threaded end portion of said screw bolt, an elastic element restrained between said cam and said frictional force adjusting nut, for urging them to move apart from each other, means for adjusting the gap between said cam and said frictional force adjusting nut so as to adjust the urging force exerted therebetween by said elastic element and enable said second jaw drive means to rotate integrally with said screw bolt.

3. A reel clamping as claimed in claim 2, wherein said cam is provided with a plurality of cam surfaces, and one end portion of each of said second jaws is pivotally connected with said jaw seat and the cam surfaces conduct the other end portion of each of said jaws to protrude from or to retract into said through slots when said cam is rotated integrally with said screw bolt.

4. A reel clamping device as claimed in claim 2, wherein said cam is provided with a plurality of cam slots, and said second jaws are conducted by pins penetrating through the cam slots to protrude from or to retract into said through slots when said cam is rotated integrally with said screw bolt.

* * * * *